US005141105A

United States Patent [19]

Maye

[11] Patent Number: 5,141,105

[45] Date of Patent: Aug. 25, 1992

[54] DISPLAY RACK ASSEMBLY

[76] Inventor: Robert Maye, 6414 Lake Worth Rd., Lake Worth, Fla. 33463

[21] Appl. No.: 730,638

[22] Filed: Jul. 16, 1991

[51] Int. Cl.[5] ..... B65D 5/50

[52] U.S. Cl. ..... 206/44 R; 206/45.14; 206/45.19; 206/491

[58] Field of Search ..... 206/44, 45.14, 45.19, 206/491

[56] References Cited

U.S. PATENT DOCUMENTS 1,916,647 7/1933 Walker ..... 206/45.19

2,464,951 3/1949 Stengren ..... 206/45.19

4,294,397 10/1981 Kohler ..... 206/45.19

4,991,804 2/1991 Iannucci ..... 206/44 R

*Primary Examiner*—Wiliam I. Price

*Attorney, Agent, or Firm*—Kane, Dalsimer, Sullivan, Kurucz, Levy, Eisele and Richard

[57] ABSTRACT

A display rack is described, which is fabricated from a minimum number of recyclable, cellulosic components. The unit is easy to assemble and disassemble without a need for tools, and may be pre-packed for gravity feed of articles to be merchandised.

11 Claims, 3 Drawing Sheets

DISPLAY RACK ASSEMBLY

BACKGROUND OF THE INVENTION

Field of the Invention

The invention relates to display racks for merchandising retail products and more particularly relates to an easy to assemble rack fabricated from recyclable materials.

SUMMARY OF THE INVENTION

The invention comprises a display rack, which comprises;

A. a single, integral sheet of a recyclable cellulosic material, folded upon itself to form (1.) a front panel having a top edge, a bottom edge and parallel first and second side edges;

(2.) a back panel having a top edge, a bottom edge and parallel first and second side edges;

(3.) a first side panel integrally joined to and part of the first side edge of the front panel and to the first side edge of the back panel, said side panel being co-extensive with and spacing apart the first side edges of the front and the back panels;

(4.) a second side panel integrally joined to and part of the second side edge of one of said front and back panels and extending towards the other of said front and back panels, said second side panel being co-extensive with and spacing apart the second side edges of the front and the back panels;

(5.) a seam panel integrally joined to and part of the second side edge of the other of said front and back panel and extending towards and overlapping the extended portion of the second side panel, said seam panel being co-extensive with the second side edge of the other of said front and back panels; said front panel, back panel, first and second side panels and seam panel together forming and defining an interior chamber with a pre-determined distance between the front and the back panels;

(6.) a first aperture, in the front panel, extending from the front panel first side edge to the front panel second side edge at a location between the top edge and the bottom edge, said aperture being bounded by a top edge, a bottom edge and parallel side edges;

(7.) a first flap, integral with and hingedly extending from the bottom edge of the aperture into the interior chamber a distance from the aperture bottom edge greater than said pre-determined distance, angled upward from the aperture bottom edge towards the back panel top edge, said flap forming a support member the angled portion of which is on a line transverse to a straight line extending from the top edge to the bottom edge of the front panel and the back panel;

(8.) a second aperture, in the back panel, extending from the back panel first side edge to the back panel second side edge at a location between the top edge and the bottom edge of the back panel, said second aperture being bounded by a top edge, a bottom edge and parallel side edges;

(9.) a second flap, integral with and hingedly extending from the top edge of the second aperture into the interior chamber a distance from the second aperture top edge greater than said pre-determined distance, angled downward from the second aperture top edge towards the front panel, said second flap forming a second support member transverse to a straight line extending from the top edge to the bottom edge of the front panel and the back panel;

(10.) a third aperture, in the back panel, extending from the back panel first side edge to the back panel second side edge at a location between the top edge and the bottom edge of the back panel and spaced apart from the second aperture, said third aperture being bounded by a top edge, a bottom edge and parallel side edges;

(11.) a third flap, integral with and hingedly extending from the bottom edge of the third aperture into the interior chamber a distance from the third aperture bottom edge greater than said pre-determined distance, angled upward from the third aperture bottom edge toward the front panel, said third flap forming a third support member transverse to a straight line extending from the top edge to the bottom edge of the top panel and the back panel;

said second and third apertures together being partially in parallel alignment with the first aperture, the bottom edge of the second aperture being on a line parallel to a straight line drawn between the side edges of the first aperture and the top edge of the third aperture being on a line parallel to a straight line drawn between the side edges of the first and second edges of the first aperture;

B. means on the flap seam for securing the flap seam to the second side panel;

C. a rack shelf which comprises; a single, integral sheet of a recyclable cellulosic material folded upon itself to form (1.) a planar sheet having a top surface, a bottom surface, first and second parallel edges, third and fourth parallel edges and at least one fold line traversing the sheet between the third and fourth opposing parallel edges, said sheet being folded upwardly along said fold line, forming a "V" in cross-section, projecting an upwardly folded portion towards the top surface of the remaining portion of the planar sheet; said folded planar sheet being adopted by size and configuration to fit within the interior chamber between the first, second and third flaps, supported by the first and third flaps and the back panel; and (2.) tab means on at least one of the planar sheet first and second edges for securing the folded planar sheet to the front panel and/or back panel within the interior chamber, in alignment with the first aperture in the front panel, said third edge abutting the second side panel and said fourth edge abutting the first side panel;

said rack shelf being partially supported by and overlaying the third flap.

DETAILED DESCRIPTION OF THE PREFERRED EMBODIMENTS OF THE INVENTION

Figure 1:
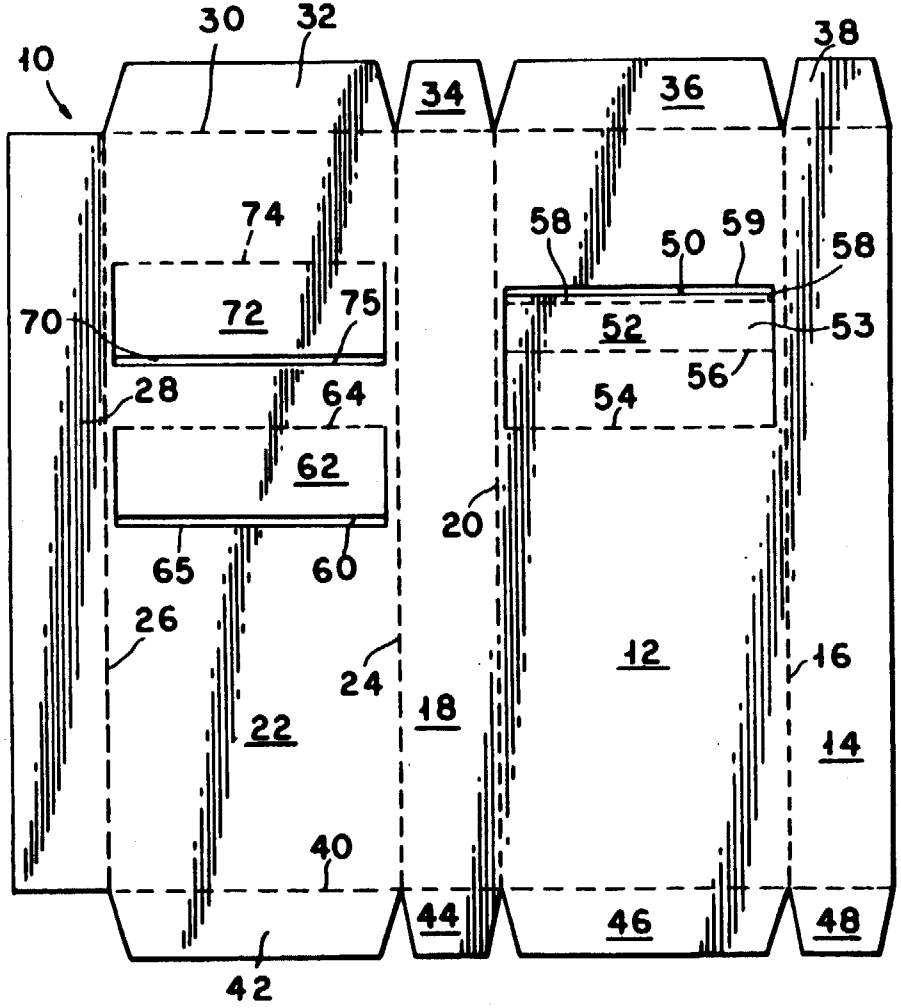
FIG. 1 is a plan view of an unassembled display rack embodiment of the invention.

Those skilled in the art will gain an appreciation of the invention from the following description of preferred embodiments when viewed together with the accompanying drawings of FIGS. 1-7, inclusive. Referring first to FIG. 1 there is seen a plan view of an unassembled display rack of the invention. The unit comprises a single, integral sheet 10 of a recyclable cellulosic material, folded upon itself to form a front panel 12 having a top edge delineated by fold line 30, a bottom edge delineated by fold line 40 and parallel second and first side edges delineated by fold lines 16, 20 respectively. A back panel 22 has a top edge delineated by the fold line 30, a bottom edge delineated by the fold line 40 and parallel first and second side edges delineated by fold lines 24, 26 respectively. A first side panel 18 is integrally joined to the first side edge of the front panel 12 and to the first side edge of the back panel 22, delineated by the fold lines 20 and 24. The side panel 18 is co-extensive with and spaces apart the first side edges of the front and back panels 12, 22. A second side panel 14 integrally joined to the second side edge of front panel 12 extends outwardly and is co-extensive with the front panel 12. The side panel 14 is integrally joined to the front panel 12 along fold line 16. Alternatively, the side panel 14 can be repositioned to switch places with seam panel 28. As shown in FIG. 1, seam panel 28 is integrally joined to the second side edge of the back panel 22 and extends outwardly therefrom. Seam panel 28 overlaps the extended portion of the second side panel 14 when the unit is assembled. The seam panel 28 is co-extensive with the second side edge of the back panel 22. In the embodiment of FIG. 1, the seam panel 28 is co-extensive with and separated from back panel 22 by fold line 26. The front panel 12, back panel 22, first and second side panels 14, 18 and seam panel 28 upon folding along fold lines 16, 20, 24 and 28 form and define an interior chamber 89 (see FIG. 5) with a predetermined distance between the front and back panels 12, 22, the predetermined being determined by the width of the side panels 14, 18. The seam panel 28 may overlap and be secured to side panel 14 using conventional means such as adhesive, staples, rivets, and like securing means, to partially assemble the display rack.

A first aperture 50 appears in front panel 12 extending from the front panel 12 second side edge to the front panel 12 first side edge (fold lines 6, 20 respectively) at a location between the top edge (fold line 30) and the bottom edge (fold line 0). The aperture 50 is bounded by a top edge 59 and a bottom edge 54 and parallel side edges coinciding with the fold lines 16, 20. A first flap 52 is integral with and hingedly extends from the bottom edge 54 of the aperture 50 into the interior chamber 89 a distance greater than the predetermined distance described above. The flap 52 forms an upwardly angled support member transverse to a line drawn from fold line 30 to fold line 40 on the surface plane of the front panel 12. The flap 52 angles upward within chamber 89 and the upward end rests upon and is supported by contact with back panel 22. Flap 52 folds towards aperture 50 along fold line 56 to form a back wall 53 (see FIG. 5) parallel to back panel 22. A second fold line 58 forms extension parallel to fold line 56 adjacent the free end of back wall 53. A second aperture 60 in back panel 22 extends from the back panel 22 first side edge to the back panel 22 second side edge (along fold lines 24, 26 respectively) at a location between the top edge (fold line 30) and the bottom edge (fold line 40) of the back panel 22. Second aperture 60 is bounded by a top edge 64, a bottom edge 65 and parallel side edges which coincide with respective fold lines 24, 26. A second flap 62 is integral with and hingedly extends from the top edge 64 of the second aperture 60 into the interior chamber 89, a distance greater than said pre-determined distance, so that the free, inwardly projecting end is angled downward and rests upon the back panel 22, said second flap 62 forming a second support member on a line transverse to a straight line drawn from fold line 30 to fold line 40 of back panel 22. A third aperture 70 in the back panel 22 extends from the back panel 22 first side edge to the back panel 22 second side edge (coinciding with respective fold lines 24, 26) at a location between the top edge (fold line 30) and the bottom edge (fold line 40) of back panel 22 and spaced apart from the second aperture 60, said third aperture being bounded by a top edge 74, a bottom edge 75 and parallel side edges coinciding with the respective fold lines 24, 26. A third flap 72, integral with and hingedly extending from the top edge 74 of the third aperture 70 into the interior chamber 89 a distance greater than the pre-determined distance, this third flap 72 projects downwardly into chamber 89 (see FIG. 5) to rest upon and be supported by the front panel 12, forming a third support member on a line transverse to line drawn between top fold line 30 and bottom fold line 40 on the plane of back panel 22. The second and third apertures 60, 70 are each partially in complete alignment with the first aperture 50. The bottom edge 75 and the top edge 64 of the respective second and third apertures are parallel to a line drawn between fold lines 16, 20 through of the center of first aperture 50. Extending outwardly from the top edge along fold line 30 are integrally joined flap extensions 32, 34, 36 and 38. Extending outwardly from the bottom edge 40 are integrally joined flap extension 42, 44, 46 and 48. When the sheet 10 is folded along all of the fold lines 16, 20, 24, 28, 30 and 40; the extended flaps 32, 34, 36, 38 and 42, 44, 46 and 48 cooperate with each other to close the top and bottom ends respectively of the assembled rack display of the invention as shown more clearly in FIGS. 4 and 5. The extended flaps at the top and bottom edges of sheet 10 may be sealed together to close interior chamber 89.

Figure 2:
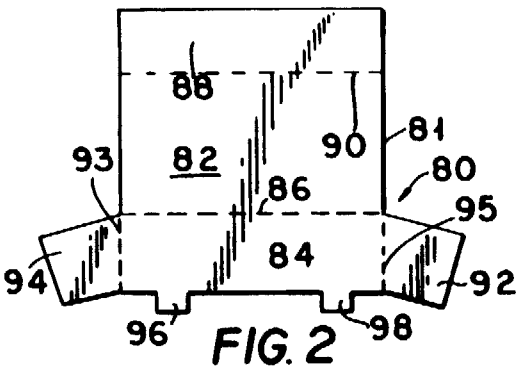
FIG. 2 is a plan view of an unassembled shelf component of the embodiment display rack of the invention.

Referring now to FIG. 2, there is seen a plan view of a rack shelf component which may be used with the folded sheet 10 described above. Shown in FIG. 2 is a single, integral sheet 80 of a recyclable cellulosic material folded upon itself to form a planar sheet 81 having a top surface, a bottom surface (not seen in FIG. 2) and a peripheral edge defining the outer boundary of the sheet 81. A fold line 86 traverses the sheet 81 between opposing parallel edges, said sheet being folded upwardly along the fold line 86, projecting the folded portion 82 upward and away from the top surface of the remaining portion 84 of the sheet 81. A second fold line 90 traverses the sheet 81 parallel to fold line 86, thereby delineating portions 82, 88 from each other. The portion 84 becomes the bottom surface of the rack shelf of the assembly, and includes tabs 96, 98 for securing the shelf 80 to front panel 12 within the aperture 50 described above. The assembled and folded sheet 81 is of a size and configuration to fit in interior chamber 89 in alignment with aperture 50 between flaps 62, 72. In this manner the sheet 81 is secured within the interior chamber 89, as shown more clearly in FIG. 5. In the preferred shelf component of the invention, outwardly extending flaps 92, 94 hold the sheet 81 in position within aperture 50 by their frictional engagement and abutment with the inner aspects of side panels 14, 18 respectively, when the sheet 10 is folded and assembled as described above. The flaps 92, 94 are folded inwardly along fold lines 93, 95 respectively so as to project upwardly from portion 84.

Figure 3:
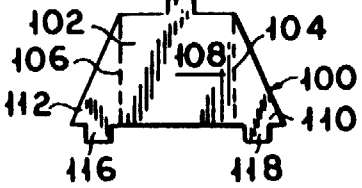
FIG. 3 is a plan view of an unassembled vertical divider component of the embodiment display of the invention.
Figure 4:
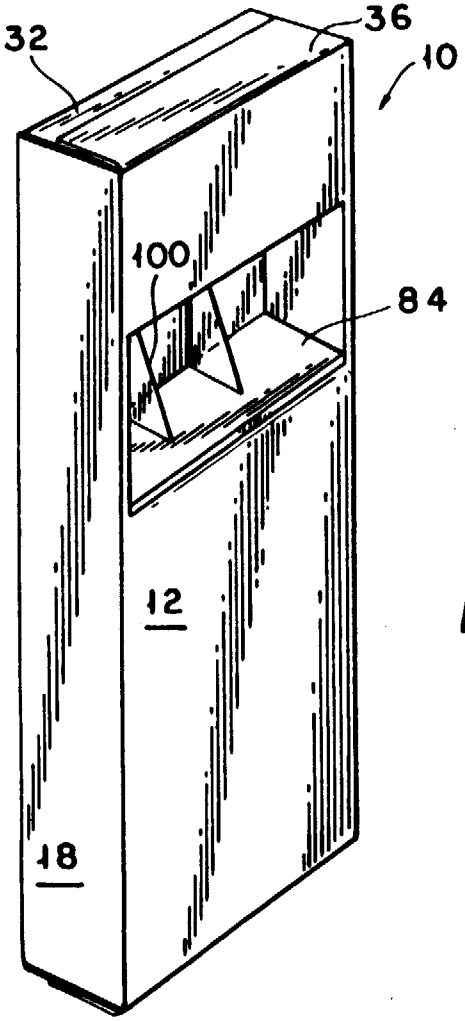
FIG. 4 is a view in perspective of an assembled display rack of the invention, assembled from the components shown in FIGS. 1-3, inclusive.

FIG. 3 is a plan view of an unassembled vertical shelf divider for use in conjunction with the shelf 80 described above. The shelf divider 100 is an integral, single sheet of recyclable cellulosic material which includes a panel 108. Panel 108 is delineated by a top edge, a bottom edge and along side fold lines 104, 106. When the projected portion beyond fold line 104 is upwardly folded, a side extension 110 forms a divider. Similarly, when upwardly folded along fold line 106, the extension 112 forms a vertical divider. The divider 108 may be secured by virtue of extended tabs 116 and 118 which can be used to engage appropriate cuts in the portion 84 of shelf 80 and a tab 114 at the top edge of sheet 108 can be secured with an appropriate cut in the portion 88 of shelf 80. The divider 100 when assembled with shelf 80 provides vertical support for the shelf 80. When fully assembled as shown in FIG. 4, the display rack of the invention provides a gravity feed means for the exhibition of articles of manufacture for display. Although only one shelf 80 has been described above, it will be appreciated by those skilled in the art that multiple apertures 50 can be provided so that a plurality of shelves 80 are employed in the display rack vertically arranged in respect to each other. For clarity of description, the assembly shown in the FIGS. 1-5, is limited to a single shelf component.

Figure 5:
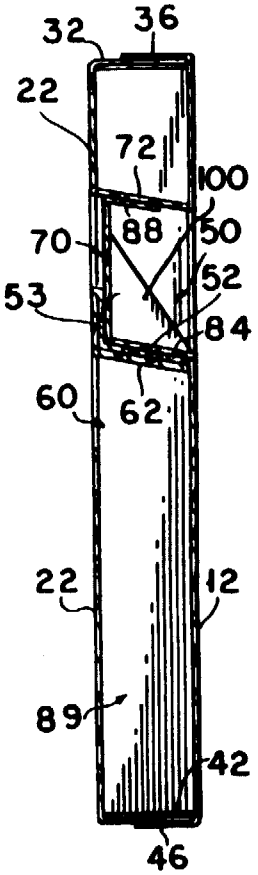
FIG. 5 is a cross-sectional side elevation of the assembled display rack shown in FIG. 4.

Referring now to FIG. 5, a side elevation in section of the embodiment display rack of FIG. 4, one can see further details of the structure. It should be noticed that support strength for panels 12, 22 of the display rack of the invention, along lines perpendicular to the overall plane of the display unit is achieved by the sealing together of end flaps 32, 36 and end flaps 42, 46. Also, flap 62 can be adhesively sealed to flap 52 which in turn supports and can be adhesively sealed to the portion 84 of shelf 80 while portion 88 of shelf 80 is adhesively secured to the inner side of flap 72. Since the flaps 62, 72 have a length greater than the distance between back panel 22 and front panel 12, they are biased and wedged in place to further support the unit on an axis transverse to the overall lengthwise plane of the unit itself. The portion 82 of shelf 80 provides vertical support for the unit, and may be adhesively secured to the inner aspect of back panel 22, for further strength. These vertical supporting elements are in addition to the vertical support offered by the divider 100 previously described.

Figure 6:
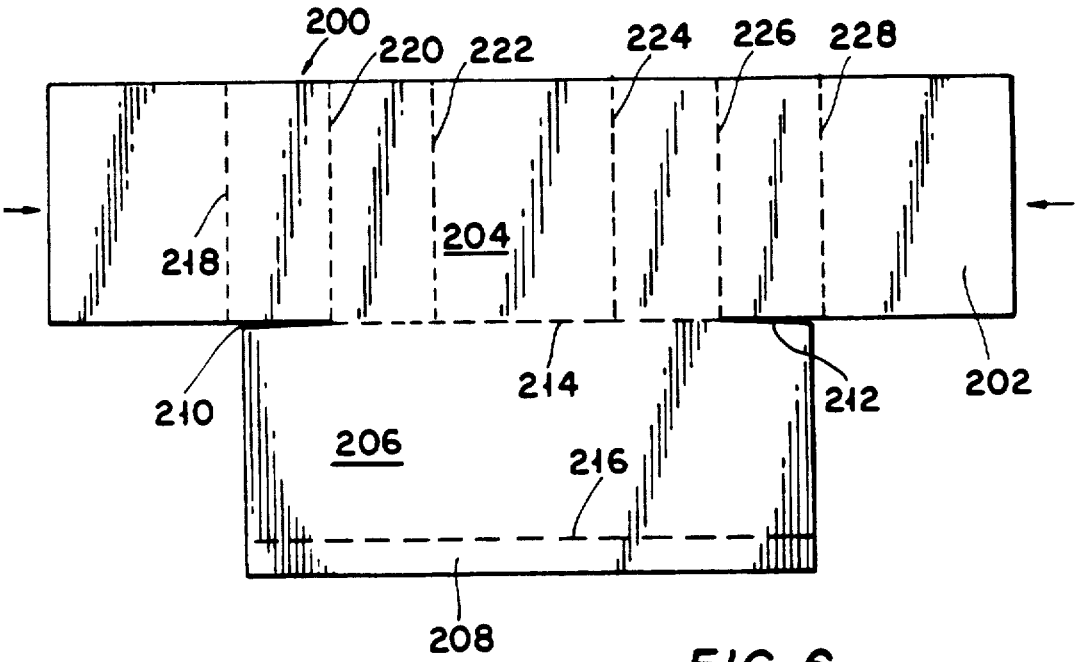
FIG. 6 is a plan view of an unassembled alternate embodiment shelf component of the display rack of the invention.
Figure 7:
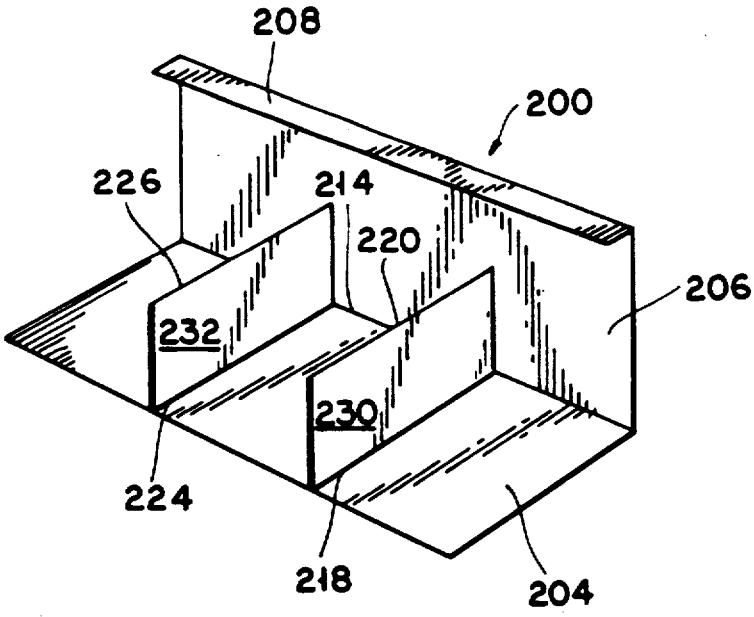
FIG. 7 is a view of the shelf component of FIG. 6, assembled.

FIG. 6 is a plan view of an alternate embodiment shelf component for the display rack of the invention. The shelf 200 is an integral, single sheet of a recyclable cellulosic material. The planar sheet 202 has a top surface, a bottom surface (not seen in FIG. 6) and a peripheral edge defining the boundary of the sheet 202. The sheet 202 is divided into three portions, 204, 206 and 208. The portions 204 and 206 are delineated and separated by slits 210 and 212 and fold line 214 at the terminus of each slit 210 and 212. The portions 204, 206 may be folded toward each other along the fold line 214. The portions 206 and 208 are delineated by and separated by a fold line 216 which parallels the fold line 214. The portions 206 and 208 can be folded towards each other along fold line 216. The portion 204 bears a plurality of fold lines 218, 220, 222, 224, 226, and 228, which run perpendicular to the axis of fold line 214, traversing the portion 204. When portion 204 is folded accordian-like along the fold lines 218, 220, 222, 224, 226, 228 vertical dividers 230 and 232 are formed (see FIG. 7). Referring now to FIG. 7, one can see the partially assembled shelf 200 with vertical dividers, for insertion through the aperture 50 into interior chamber 89 in the same manner as shelf 80 described above. The shelf 200 is fabricated in a size and configuration to fit within interior chamber 89 between flaps 62 and 72 as does shelf 80.

The display rack of the invention may be fabricated from any conventional material commonly employed as a low cost shelf material, and which is recyclable. Preferably, the material employed is a cellulosic sheet such as a sheet of corrugated Kraft paperboard. Of course, the dimensions and weight of paperboard have to be selected from materials which will provide both compressive and bending strengths supportive of the articles to be displayed on the unit assembly. A preferred cellulosic sheet is one constructed from linerboard, i.e., a lamination of two face sheets of paper, sandwiching a honeycomb core of paper. Paper honeycomb materials may be fabricated by methods well known in the art; see for example the U.S. Pat. Nos. 3,518,151; 3,519,510; and 3,713,954; all of which are hereby incorporated herein by reference thereto. Methods of adhering honeycomb materials to facing sheets are also well known; see for example U.S. Pat. No. 2,815,795 which is incorporated herein by reference thereto.

The display racks of the invention may be fabricated in any size, so that they may be relatively large and free standing or relatively small and secured to a wall. Advantageously the racks may be pre-packed with articles to be gravity fed and displayed within the aperture 50, at the manufacturers facility.

It will be appreciated by those skilled in the art that many modifications may be made to the above described preferred embodiments of the invention without departing from the spirit and scope of the invention. The assembly may be put together or knocked down without a requirement for tools of any sort. Also, surfaces of the paper components which contact the gravity fed articles to be displayed may be coated with a varnish or silicone to facilitate and reduce friction between the shelf and the article to b displayed.

What is claimed is:

1. A display rack, which comprises;

A. a single, integral sheet of a recyclable cellulosic material, folded upon itself to form (1.) a front panel having a top edge, a bottom edge and parallel first and second side edges;

(2.) a back panel having a top edge, a bottom edge and parallel first and second side edges;

(3.) a first side panel integrally joined to and part of the first side edge of the front panel and to the first side edge of the back panel, said side panel being co-extensive with and spacing apart the first side edges of the front and the back panels;

(4.) a second side panel integrally joined to and part of the second side edge of one of said front and back panels and extending towards the other of said front and back panels, said second side panel being co-extensive with and spacing apart the second side edges of the front and the back panels;

(5.) a seam panel integrally joined to and part of the second side edge of the other of said front and back panel and extending towards and overlapping the extended portion of the second side panel, said seam panel being co-extensive with the second side edge of the other of said front and back panels; said front panel, back panel, first and second side panels and seam panel together forming and defining an interior chamber with a pre-determined distance between the front and the back panels;

(6.) a first aperture, in the front panel, extending from the front panel first side edge to the front panel second side edge at a location between the top edge and the bottom edge, said aperture being bounded by a top edge, a bottom edge and parallel side edges;

(7.) a first flap, integral with and hingedly extending from the bottom edge of the aperture into the interior chamber a distance from the aperture bottom edge, greater than said predetermined distance, angled upward from the aperture bottom edge towards the back panel top edge, said flap forming a support member the angled portion of which is on a line transverse to a straight line extending from the top edge to the bottom edge of the front panel and the back panel;

(8.) a second aperture, in the back panel, extending from the back panel first side-edge to the back panel second side edge at a location between the top edge and the bottom edge of the back panel, said second aperture being bounded by a top edge, a bottom edge and parallel side edges;

(9.) a second flap, integral with and hingedly extending from the top edge of the second aperture into the interior chamber a distance from the second aperture top edge greater than said pre-determined distance, angled downward from the second aperture top edge towards the front panel, said second flap forming a second support member transverse to a straight line extending from the top edge to the bottom edge of the front panel and the back panel;

(10.) a third aperture, in the back panel, extending from the back panel first side edge to the back panel second side edge at a location between the top edge and the bottom edge of the back panel and spaced apart from the second aperture, said third aperture being bounded by a top edge, a bottom edge and parallel side edges;

(11.) a third flap, integral with and hingedly extending from the top edge of the third aperture into the interior chamber a distance from the third aperture top edge greater than said pre-determined distance, angled downward from the third aperture top edge toward the front panel, said third flap forming a third support member transverse to a straight line extending from the top edge to the bottom edge of the top panel and the back panel;

said second and third apertures together being partially in parallel alignment with the first aperture, the top edge of the second aperture being on a line parallel to a straight line drawn between the side edges of the first aperture and the bottom edge of the third aperture being on a line parallel to a straight line drawn between the side edges of the first aperture;

B. means on the seam panel for securing the seam panel to the second side panel;

C. a rack shelf which comprises; a single, integral sheet of a recyclable cellulosic material folded upon itself to form (1.) a planar sheet having a top surface, a bottom surface, first and second parallel edges, third and fourth parallel edges and at least one fold line traversing the sheet between the third and fourth opposing parallel edges, said sheet being folded upwardly along said fold line, forming a "V" in cross-section, projecting an upwardly folded portion towards the top surface of the remaining portion of the planar sheet; said folded planar sheet being adopted by size and configuration to fit within the interior chamber between the first, second and third flaps, supported by the first and third flaps and the back panel; and (2.) tab means on at least one of the planar sheet first and second edges for securing the folded planar sheet to the front panel and/or back panel within the interior chamber, in alignment with the first aperture in the front panel, said third edge abutting the second side panel and said fourth edge abutting the first side panel; said rack shelf being partially supported by and overlaying the second flap.

2. The display rack of claim 1 wherein the cellulosic material is corrugated Kraft paperboard.

3. The display rack of claim 1 wherein the means on the seam panel is an adhesive means.

4. The display rack of claim 1 which further comprises flap means on the top edge of the front, back and side panels for closing the top end of the interior chamber.

5. The display rack of claim 4 which further comprises flap means on the bottom edge of the front, back and side panels for closing the bottom end of the interior chamber.

6. The display rack of claim 1 wherein the rack shelf is secured within the interior chamber between the first, second and third flaps, supported by the first and third flaps and the back panel, said shelf having mounted thereon at least one vertical divider.

7. The display rack of claim 6 wherein the rack shelf is surface coated with a varnish or silicone to reduce surface friction.

8. The display rack of claim 6 wherein the vertical divider is an integral part of the shelf, which comprises a single sheet of the cellulosic material.

9. The display rack of claim 1 including means providing a free standing unit.

10. The display rack of claim 1 having means to hang said rack on a wall.

11. A display rack, which comprises;

A. a single, integral sheet of corrugated Kraft paperboard, folded upon itself to form (1.) a front panel having a top edge, a bottom edge and parallel first and second side edges;

(2.) a back panel having a top edge, a bottom edge and parallel first and second side edges;

(3.) a first side panel integrally joined to and part of the first side edge of the front panel and to the first side edge of the back panel, said side panel being co-extensive with and spacing apart the first side edges of the front and the back panels;

(4.) a second side panel integrally joined to and part of the second side edge of one of said front and back panels and extending towards the other of said front and back panels, said second side panel being co-extensive with and spacing apart the second side edges of the front and the back panels;

(5.) a seam panel integrally joined to and part of the second side edge of the other of said front and back panel and extending towards and overlapping the extended portion of the second side panel, said seam panel being co-extensive with the second side edge of the other of said front and back panels; said front panel, back panel, first and second side panels and seam panel together forming and defining an interior chamber with a pre-determined distance between the front and the back panels;

(6.) a first aperture, in the front panel, extending from the front panel first side edge to the front panel second side edge at a location between the top edge and the bottom edge, said aperture being bounded by a top edge, a bottom edge and parallel side edges;

(7.) a first flap, integral with and hingedly extending from the bottom edge of the aperture into the interior chamber a distance from the aperture bottom edge, greater than said predetermined distance, angled upward within the range of from 30° to 50 degrees from the aperture bottom edge towards the back panel top edge, said flap forming a support member the angled portion of which is on a line transverse to a straight line extending from the top edge to the bottom edge of the front panel and the back panel;

(8.) a second aperture, in the back panel, extending from the back panel first side edge to the back panel second side edge at a location between the top edge and the bottom edge of the back panel, said second aperture being bounded by a top edge, a bottom edge and parallel side edges;

(9.) a second flap, integral with and hingedly extending from the top edge of the second aperture into the interior chamber a distance from the second aperture top edge greater than said pre-determined distance, angled downward within the range of from about 30° to 50 degrees from the second aperture top edge towards the front panel, said second flap forming a second support member transverse to a straight line extending from the top edge to the bottom edge of the front panel and the back panel;

(10.) a third aperture, in the back panel, extending from the back panel first side edge to the back panel second side edge at a location between the top edge and the bottom edge of the back panel and spaced apart from the second aperture, said third aperture being bounded by a top edge, a bottom edge and parallel side edges;

(11.) a third flap, integral with and hingedly extending from the top edge of the third aperture into the interior chamber a distance from the third aperture top edge greater than said pre-determined distance, angled downward at an angle of from about 30° to 50 degrees from the third aperture top edge toward the front panel, said third flap forming a third support member transverse to a straight line extending from the top edge to the bottom edge of the top panel and the back panel;

said second and third apertures together being partially in parallel alignment with the first aperture, the top edge of the second aperture being on a line parallel to a straight line drawn between the side edges of the first aperture and the bottom edge of the third aperture being on a line parallel to a straight line drawn between the side edges of the first aperture;

B. adhesive means on the seam panel for securing the seam panel to the second side panel;

C. a rack shelf which comprises;

a single, integral sheet of a corrugated Kraft paperboard material folded upon itself to form (1.) a planar sheet having a top surface, a bottom surface, first and second parallel edges, third and fourth parallel edges and at least one fold line traversing the sheet between the third and fourth opposing parallel edges, said sheet being folded upwardly along said fold line, forming a "V" in cross-section, projecting an upwardly folded portion towards the top surface of the remaining portion of the planar sheet; said folded planar sheet being adopted by size and configuration to fit within the interior chamber between the first, second and third flaps, supported by the first and third flaps and the back panel; and (2.) tab means on at least one of the planar sheet first and second edges for securing the folded planar sheet to the front panel and/or back panel within the interior chamber, in alignment with the first aperture in the front panel, said third edge abutting the second side panel and said fourth edge abutting the first side panel;

said rack shelf being partially supported by and overlaying the second flap;

D. flap means on the top edge of the front, back and side panels for closing the top end of the interior chamber;

E. flap means on the bottom edge of the front, back and side panels for closing the bottom end of the interior chamber; and F. at least one vertical divider mounted on the rack shelf.

* * * * *